US011125026B2

(12) United States Patent
El-Hayek et al.

(10) Patent No.: US 11,125,026 B2
(45) Date of Patent: Sep. 21, 2021

(54) COMPLETING SLIM-HOLE HORIZONTAL WELLBORES

(71) Applicant: Saudi Arabian Oil Company, Dhahran (SA)

(72) Inventors: Soha Omar El-Hayek, Dhahran (SA); Essam M. Alyan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/169,778

(22) Filed: Oct. 24, 2018

(65) Prior Publication Data

US 2020/0131861 A1 Apr. 30, 2020

(51) Int. Cl.

| | |
|---|---|
| ***E21B 17/20*** | (2006.01) |
| ***E21B 19/22*** | (2006.01) |
| ***E21B 33/12*** | (2006.01) |

(52) U.S. Cl.

CPC ..... *E21B 17/203* (2013.01); *E21B 19/22* (2013.01); *E21B 33/1208* (2013.01)

(58) Field of Classification Search

CPC ..... E21B 17/20; E21B 17/203; E21B 19/22; E21B 33/1208; E21B 43/08

See application file for complete search history.

(56) References Cited

U.S. PATENT DOCUMENTS

| | | | | |
|---|---|---|---|---|
| 2,738,013 A * | 3/1956 | Lynes | E21B 33/1216 | 277/338 |
| 2,986,214 A | 5/1961 | Wiseman et al. | | |
| 3,333,635 A | 8/1967 | Crawford | | |
| 3,527,298 A * | 9/1970 | Zerb | E21B 27/00 | 166/162 |
| 4,498,543 A | 2/1985 | Pye | | |
| 5,353,875 A * | 10/1994 | Schultz | E21B 43/116 | 166/297 |
| 5,411,082 A * | 5/1995 | Kennedy | E21B 7/061 | 166/181 |

(Continued)

FOREIGN PATENT DOCUMENTS

| | | |
|---|---|---|
| EP | 0796980 | 9/1997 |
| WO | 01161146 | 8/2001 |

OTHER PUBLICATIONS

Geddes, "Innovative Water Shutoff Solutions Using Coiled Tubing Conveyed Inflatable Devices," SPE 76709, presented at the SPE Western Regional/AAPG Pacific Section Joint Meeting on May 20-22, 2002, 10 pages.

(Continued)

*Primary Examiner* — Aaron L Lembo

(74) *Attorney, Agent, or Firm* — Fish & Richardson P.C.

(57) ABSTRACT

A length of coiled tubing is installed into a horizontal side-track wellbore. The coiled tubing has a pre-perforated section that defines perforations between a first end of the perforated section and a second end of the perforated section. The perforated section is positioned to align with a zone of interest within the horizontal side-track wellbore. A first isolation packer surrounds the length of coiled tubing. The first isolation packer is attached to the length of coiled tubing at the first end of the pre-perforated section. A second isolation packer surrounds the length of coiled tubing. The second isolation packer is attached to the length of coiled tubing at the second end of the pre-perforated section.

8 Claims, 2 Drawing Sheets

(56) References Cited

U.S. PATENT DOCUMENTS

| | | | | |
|---|---|---|---|---|
| 5,427,177 | A * | 6/1995 | Jordan, Jr. | E21B 7/061 166/117.5 |
| 5,449,039 | A * | 9/1995 | Hartley | E21B 34/14 166/297 |
| 5,662,165 | A | 9/1997 | Tubel et al. | |
| 5,664,628 | A * | 9/1997 | Koehler | B01D 29/111 166/369 |
| 5,671,809 | A | 9/1997 | McKinzie | |
| 5,697,441 | A | 12/1997 | Vercaemer | |
| 5,704,426 | A * | 1/1998 | Rytlewski | E21B 23/00 166/297 |
| 5,730,221 | A * | 3/1998 | Longbottom | E21B 29/06 166/298 |
| 6,082,454 | A | 7/2000 | Tubel | |
| 6,318,469 | B1 | 11/2001 | Patel | |
| 6,394,184 | B2 * | 5/2002 | Tolman | E21B 17/203 166/120 |
| 6,446,727 | B1 * | 9/2002 | Zemlak | E21B 17/20 166/177.5 |
| 6,497,290 | B1 | 12/2002 | Misselbrook et al. | |
| 6,615,920 | B1 * | 9/2003 | Collins | E21B 41/0035 166/313 |
| 8,220,547 | B2 * | 7/2012 | Craig | E21B 43/26 166/308.1 |
| 8,528,630 | B2 * | 9/2013 | Tunget | E21B 23/14 166/55.8 |
| 8,555,978 | B2 * | 10/2013 | Ganelin | E21B 17/01 166/344 |
| 9,016,391 | B1 * | 4/2015 | Chauffe | E21B 33/1208 166/180 |
| 9,140,119 | B2 * | 9/2015 | Deen | E21B 49/087 |
| 9,234,402 | B2 * | 1/2016 | Vinge | E21B 43/128 |
| 9,249,559 | B2 | 2/2016 | Dyer | |
| 9,328,600 | B2 * | 5/2016 | Kaminsky | E21B 43/267 |
| 9,416,638 | B2 * | 8/2016 | Zhou | E21B 43/12 |
| 9,493,993 | B1 * | 11/2016 | Dallas | E21B 17/04 |
| 9,513,055 | B1 * | 12/2016 | Seal | F26B 19/00 |
| 9,644,463 | B2 * | 5/2017 | Dallas | E21B 43/16 |
| 9,863,414 | B2 | 1/2018 | Laing et al. | |
| 9,951,573 | B2 * | 4/2018 | Dahl | E21B 7/061 |
| 10,352,140 | B2 * | 7/2019 | Parlin | |
| 2006/0090903 | A1 | 5/2006 | Gano et al. | |
| 2006/0207763 | A1 * | 9/2006 | Hofman | E21B 43/00 166/281 |
| 2010/0319928 | A1 | 12/2010 | Bussear et al. | |
| 2011/0048743 | A1 | 3/2011 | Stafford et al. | |
| 2011/0192596 | A1 | 8/2011 | Patel | |
| 2012/0318582 | A1 | 12/2012 | Fould et al. | |
| 2013/0043025 | A1 | 2/2013 | Scott | |
| 2013/0081807 | A1 | 4/2013 | Dyer et al. | |
| 2016/0333680 | A1 * | 11/2016 | Richter | E21B 43/26 |
| 2017/0321548 | A1 * | 11/2017 | Enkababian | E21B 33/12 |
| 2018/0119533 | A1 | 5/2018 | Alhuthali et al. | |
| 2018/0155991 | A1 | 6/2018 | Arsalan et al. | |
| 2018/0363460 | A1 * | 12/2018 | Fitzel | E21B 49/081 |
| 2019/0032473 | A1 * | 1/2019 | Kuckes | E21B 47/02216 |
| 2020/0370401 | A1 | 11/2020 | El-hayek et al. | |

OTHER PUBLICATIONS

Head et al., "Slimwell concept—innovative coiled tubing completion technology," SPE 54492, presented at the 1999 SPE/ICoTA Coiled Tubing Roundtable on May 25-26, 1999, 14 pages.

Ramondenc et al., "Reviving Oil Production in a Mature Offshore Field Through a Downhole Coiled Tubing Completion," SPE 179063, presented at the SPE/ICoTA Coiled Tubing and Well Intervention Conference and Exhibition, Mar. 22-23, 2016, 11 pages.

PCT International Search Report and Written Opinion in International Appln. No. PCT/US2019/057558, dated Feb. 17, 2020, 14 pages.

Al-Ariami et al., "Striving the coil tubing limit intervention in a snake 'Long Horizontal' Complex Gas well: successful perforation and completion," SPE 105159, presented at the Coiled Tubing and Well Intervention Conference and Exhibition, The Woodlands, TX, Mar. 20-21, 2007, 8 pages.

Cooper et al., "Coiled tubing in horizontal wells," SPE 17581, presented at the SPE International Meeting on Petroleum Engineering, Tianjin, China, Nov. 1-4, 1988, 12 pages.

PCT International Search Report and Written Opinion in International Appln. No. PCT/US2020/034221, dated Aug. 11, 2020, 15 pages.

GCC Examination Report in GCC Appln. No. GC 2019-38510, dated Mar. 3, 2021, 5 pages.

* cited by examiner

COMPLETING SLIM-HOLE HORIZONTAL WELLBORES

TECHNICAL FIELD

This disclosure relates to wellbore completions.

BACKGROUND

Slim-hole wellbores are popular in certain hydrocarbon production applications as the infrastructure needed for installation is less extensive than conventional wellbores. The reduced infrastructure is due to the fact that thinner, lighter pipe sections are used during the drilling process. Slim-hole wellbores can be drilled and completed as vertical, deviated, and horizontal wellbores. When a deviated or horizontal slim-hole wellbore is formed, it is often completed as an open-hole completion as the small wellbore diameter can make it difficult for other conventional completions to be inserted and installed properly.

SUMMARY

This disclosure describes technologies relating to completing slim-hole horizontal wellbores.

An example implementation of the subject matter described within this disclosure is a coiled tubing wellbore completion with the following features. A length of coiled tubing is installed into a horizontal side-track wellbore. The coiled tubing has a pre-perforated section that defines perforations between a first end of the perforated section and a second end of the perforated section. The perforated section is positioned to align with a zone of interest within the horizontal side-track wellbore. A first isolation packer surrounds the length of coiled tubing. The first isolation packer is attached to the length of coiled tubing at the first end of the pre-perforated section. A second isolation packer surrounds the length of coiled tubing. The second isolation packer is attached to the length of coiled tubing at the second end of the pre-perforated section.

Aspects of the example implementation, which can be combined with the example implementation alone or in combination, include the following. The pre-perforated section is a first pre-perforated section. The zone of interest is a first zone of interest. The coiled tubing wellbore completion further includes a second pre-perforated section within the length of coiled tubing. The second pre-perforated section defines perforations between a first end of the second pre-perforated section and a second end of the second pre-perforated section. The second pre-perforated section is positioned to align with a second zone of interest within the horizontal side-track wellbore. A third isolation packer surrounds the length of coiled tubing. The third isolation packer is attached to the length of coiled tubing at the first end of the second pre-perforated section. A fourth isolation packer surrounds the length of coiled tubing. The fourth isolation packer is attached to the length of coiled tubing at the second end of the second pre-perforated section.

Aspects of the example implementation, which can be combined with the example implementation alone or in combination, include the following. The first pre-perforated section and the second pre-perforated section both fluidically connect the first zone of interest and the second zone of interest, respectively, to an interior flow path defined by the length of coiled tubing.

Aspects of the example implementation, which can be combined with the example implementation alone or in combination, include the following. The first isolation packer and the second isolation packer each include a swell packer that is pre-installed on the length of coiled tubing prior to installation.

An example implementation of the subject matter described within this disclosure is a method with the following features. A length of coiled tubing is inserted into a horizontal side-track wellbore to a desired distance. The length of coiled tubing includes a pre-perforated section that defines perforations between a first end of the perforated section and a second end of the perforated section. The perforated section is positioned to align with a zone of interest within the horizontal side-track wellbore. A first isolation packer surrounds the length of coiled tubing. The first isolation packer is attached to the length of coiled tubing at the first end of the pre-perforated section. A second isolation packer surrounds the length of coiled tubing. The second isolation packer is attached to the length of coiled tubing at the second end of the pre-perforated section.

Aspects of the example implementation, which can be combined with the example implementation alone or in combination, include the following. The first isolation packer and the second isolation packer are expanded once the length of coiled tubing is inserted to the desired distance.

Aspects of the example implementation, which can be combined with the example implementation alone or in combination, include the following. The coiled tubing is installed in an overbalanced condition.

Aspects of the example implementation, which can be combined with the example implementation alone or in combination, include the following. A production fluid is flowed through the pre-perforated section and through the length of coiled tubing to a topside facility.

Aspects of the example implementation, which can be combined with the example implementation alone or in combination, include the following. The pre-perforated section is a first pre-perforated section, and the zone of interest is a first zone of interest. The length of coiled tubing further includes a second pre-perforated section within the length of coiled tubing. The second pre-perforated section is positioned to align with a second zone of interest within the horizontal side-track wellbore. A third isolation packer surrounds the length of coiled tubing. The third isolation packer is attached to the length of coiled tubing at a first end of the second pre-perforated section. A fourth isolation packer surrounds the length of coiled tubing. The fourth isolation packer is attached to the length of coiled tubing at the second end of the second pre-perforated section. The method further includes commingling a flow from the first pre-perforated section and the second pre-perforated section.

Aspects of the example implementation, which can be combined with the example implementation alone or in combination, include the following. an injection fluid is flowed from a topside facility, through the length of coiled tubing, and out the pre-perforated section.

Aspects of the example implementation, which can be combined with the example implementation alone or in combination, include the following. The horizontal side-track wellbore is abandoned.

Aspects of the example implementation, which can be combined with the example implementation alone or in combination, include the following. Abandoning includes removing the length of coiled tubing from the horizontal side-track wellbore, and leaving the packers within the horizontal side-track wellbore.

Aspects of the example implementation, which can be combined with the example implementation alone or in combination, include the following. The horizontal side-track wellbore is a first horizontal side-track wellbore. The method further includes installing the removed length of coiled tubing into a second horizontal side-track wellbore that is separate and distinct from the first horizontal side-track wellbore.

Aspects of the example implementation, which can be combined with the example implementation alone or in combination, include the following. Abandoning includes leaving the length of coiled tubing within the horizontal side-track wellbore, and leaving the packers within the horizontal side-track wellbore.

An example implementation of the subject matter described within this disclosure is a well system with the following features. A wellhead has vertical production tubing. A coiled tubing hanger is within the vertical production tubing. A length of coiled tubing is supported by the coiled tubing hanger. The length of coiled tubing is installed into a horizontal side-track wellbore. The coiled tubing has a pre-perforated section defining perforations between a first end of the perforated section and a second end of the perforated section. The perforated section is positioned to align with a zone of interest within the horizontal side-track wellbore. A first isolation packer surrounds the length of coiled tubing. The first isolation packer is attached to the length of coiled tubing at the first end of the pre-perforated section. A second isolation packer surrounds the length of coiled tubing. The second isolation packer is attached to the length of coiled tubing at the second end of the pre-perforated section.

Aspects of the example implementation, which can be combined with the example implementation alone or in combination, include the following. A vertical well is fluidically coupled to the wellhead.

Aspects of the example implementation, which can be combined with the example implementation alone or in combination, include the following. The coiled tubing hanger is a first coiled tubing hanger. The length of coiled tubing is a first set of coiled tubing. The horizontal side-track wellbore is a first horizontal side-track wellbore. The pre-perforated section is a first pre-perforated section. The well system further includes a second coiled tubing hanger within the wellhead. A second length of coiled tubing supported by the second coiled tubing hanger. The second length of coiled tubing is installed into a second horizontal side-track wellbore. The second length of coiled tubing has a second pre-perforated section that defines perforations between a first end of the second pre-perforated section and a second end of the second pre-perforated section. The second pre-perforated section is positioned to align with a second zone of interest within the second horizontal side-track wellbore. A third isolation packer surrounds the second length of coiled tubing. The third isolation packer is attached to the second length of coiled tubing at the first end of the second pre-perforated section. A fourth isolation packer surrounds the second length of coiled tubing. The fourth isolation packer is attached to the second length of coiled tubing at the second end of the second pre-perforated section.

Aspects of the example implementation, which can be combined with the example implementation alone or in combination, include the following. The pre-perforated section is a first pre-perforated section, and the zone of interest is a first zone of interest. The well system further includes a second pre-perforated section within the length of coiled tubing. The second pre-perforated section is positioned to align with a second zone of interest within the horizontal side-track wellbore. A third isolation packer surrounds the length of coiled tubing. The third isolation packer is attached to the length of coiled tubing at the first end of the second pre-perforated section. A fourth isolation packer surrounds the length of coiled tubing. The fourth isolation packer is attached to the length of coiled tubing at the second end of the second pre-perforated section.

Aspects of the example implementation, which can be combined with the example implementation alone or in combination, include the following. The first pre-perforated section and the second pre-perforated section both fluidically connect the first zone of interest and the second zone of interest, respectively, to an interior flow path defined by the length of coiled tubing.

Aspects of the example implementation, which can be combined with the example implementation alone or in combination, include the following. The first isolation packer and the second isolation packer each comprise a swell packers that is pre-installed on the length of coiled tubing prior to installation.

Particular implementations of the subject matter described in this disclosure can be implemented so as to realize one or more of the following advantages. A coiled tubing completion has significantly less surface roughness than an open-hole completion, resulting in less of a pressure loss through the wellbore. The tubing string is reusable and can be deployed in other wellbores once the lifespan of the wellbore is completed. The risk of hole collapse in the slim-hole wellbore is significantly reduced with the coiled tubing completion. The completion described herein does not require a drill rig for installation or retrieval.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure relates to using coiled tubing as a completion for slim-hole side-track wellbores. The coiled tubing is fed through an open-hole side track that has previously been logged. The coiled tubing includes pre-perforated sections that are installed in-line with production zones. Pre-set swell packers are fed into the side-track with the coiled tubing and isolate the side track into production and non-production zones. The subject matter described herein is applicable to horizontal, deviated, and vertical wellbores.

Figure 1:
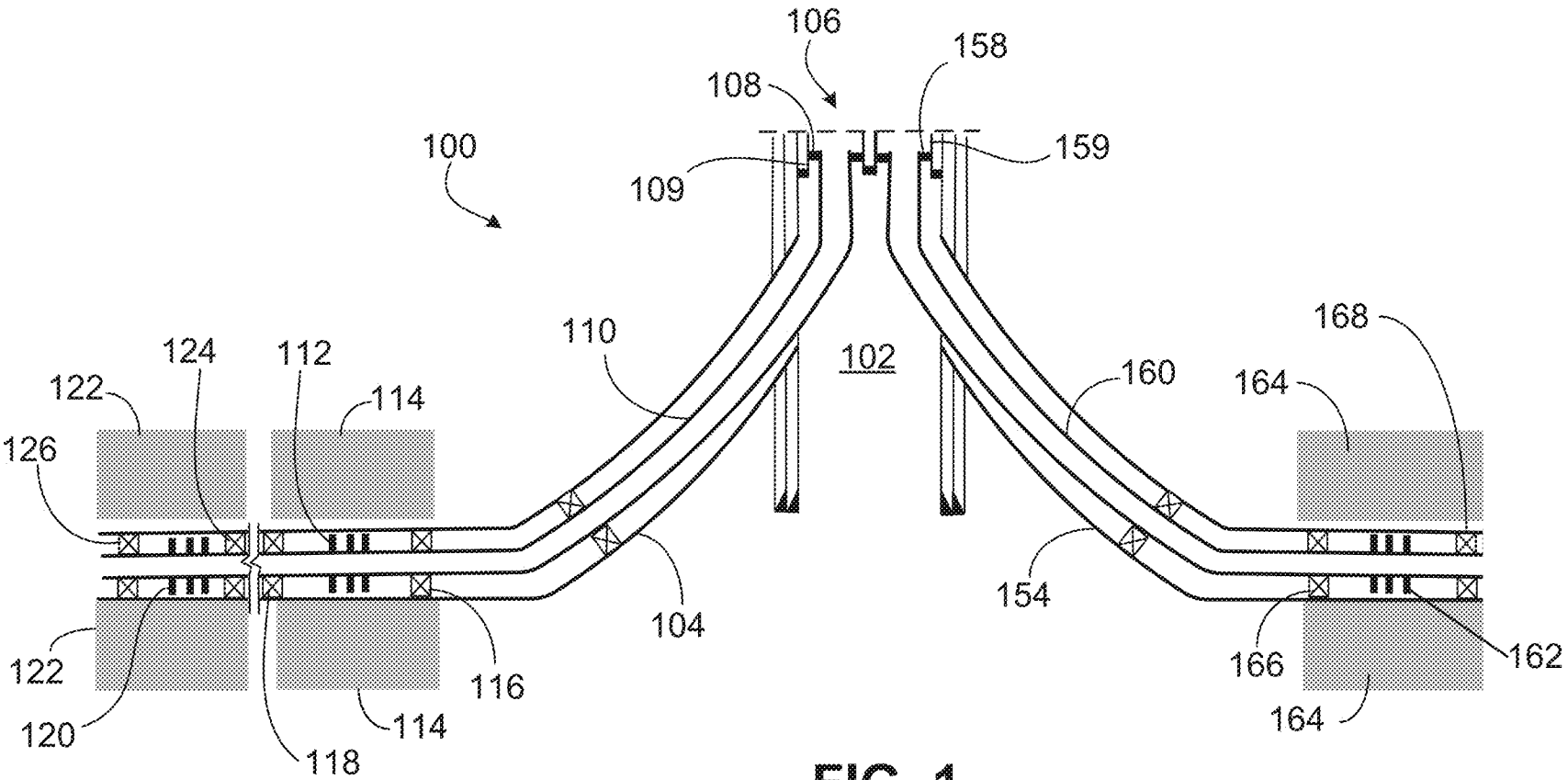
FIG. 1 is a side cross-sectional view of an example well completion that can be used with aspects of this disclosure.

FIG. 1 is a side cross-sectional view of an example well completion 100 that can be used with aspects of this disclosure. The completion 100 as illustrated includes a main, vertical wellbore 102 and a second, horizontal side-track wellbore 104. The vertical wellbore 102 terminates at a wellhead 106 that is plumbed into a topside facility (not shown). The wellhead 106 includes a tubing hanger 108. The tubing hanger 108 supports a production string in the wellbore, such as the portion of coiled tubing 110. The size of the coiled tubing can be within the size range to be considered slim-hole diameter size. For example, the diameter can range from 3½" to 1 1/16". In some implementations, the tubing hanger 108 can be positioned within a section of vertical production tubing 109. The portion of coiled tubing 110 is installed into the horizontal side-track wellbore 104. The coiled tubing has a pre-perforated section 112 defining perforations between a first end of the pre-perforated section 112 and a second end of the pre-perforated section 112. The pre-perforated section 112 is positioned to align with a zone of interest 114 within the horizontal side-track wellbore 104.

A first isolation packer 116 surrounds the portion of coiled tubing 110. The first isolation packer 116 is attached to an outer surface of the portion of coiled tubing 110 at a first end of the pre-perforated section 112. A second isolation packer 118 surrounds the portion of coiled tubing 110. The second isolation packer 118 is attached to an outer surface of the portion of coiled tubing 110 at the second end of the pre-perforated section 112. The first packer 116 and the second packer 118 are installed onto the portion of coiled tubing 110 prior to the portion of coiled tubing 110 being installed into the horizontal wellbore 104. The packers are full-bore packers, meaning they are configured to fluidically isolate an annulus defined by an outer surface of the portion of coiled tubing 110 and an inner surface of the horizontal wellbore 104. The packers are positioned such that, when activated, the first packer 116 and the second packer 118 fluidically isolate a region of the wellbore within the zone of interest 114. By fluidically isolating that region of the horizontal wellbore 104, the first packer 116 and the second packer 118 direct fluid between the portion of coiled tubing 110 and the zone of interest 114.

In some implementations, the portion of coiled tubing 110 includes a second pre-perforated section 120 within the portion of coiled tubing 110. The second pre-perforated section 120 can be positioned to align with a second zone of interest 122 within the horizontal side-track wellbore 104. A third isolation packer 124 surrounds the portion of coiled tubing 110 and is attached to the outer surface of the portion of coiled tubing 110 at a first end of the second pre-perforated section 120. A fourth isolation packer 126 surrounds the portion of coiled tubing 110 and is attached to an outer surface of the portion of coiled tubing 110 at the second end of the second pre-perforated section 120. In some implementations, the packers, coiled tubing, and horizontal side-track wellbore, all have a roughly circular cross section. Other cross section shapes are possible. The packers are full-bore packers, meaning they are configured to fluidically isolate an annulus defined by an outer surface of the portion of coiled tubing 110 and an inner surface of the horizontal wellbore 104. The packers are positioned such that, when activated, the third packer 124 and the fourth packer 126 fluidically isolate a region of the wellbore within the second zone of interest 122. By fluidically isolating that region of the horizontal wellbore 104, the third packer 124 and the fourth packer 126 direct fluid between the portion of coiled tubing 110 and the zone of interest 114. While the illustrated implementation shows a first perforated section 112 and a second perforated section 120, more or fewer perforates sections can be included on the portion of coiled tubing 110. In some implementations, such as when the first perforated sections 112 and the second perforated section 120 are adjacent to one another, a single packer can be used to separate the sections rather than the two packers illustrated.

In some implementations, the first pre-perforated section 112 fluidically connects the first zone of interest 114 to an interior flow path defined by the portion of coiled tubing 110. The second pre-perforated section 120 fluidically connects the second zone of interest 122 to the same interior flow path defined by the portion of coiled tubing 110. That is, fluid exchanged between the first zone of interest 114, the second zone of interest 114, and the interior of the portion of coiled tubing 110, is commingled. Such can be the case for either production or injection completions when both the first zone of interest 114 and the second zone of interest 122 have similar injection or production pressures. The portion of coiled tubing 110 can be used for either injection (such as liquid or gas injection) or for fluid production. In some implementations, the portion of coiled tubing 110 can be used for fracturing operations. In such an instance, the metallurgy and wall thickness of the portion of coiled tubing 110 is such that the portion of coiled tubing 110 has sufficient strength for fracturing operations.

In some implementations, the well completion 100 can include a second horizontal side-track wellbore 154. In such an implementation, the wellhead 106 includes a second tubing hanger 158. The second tubing hanger 158 supports a production string in the second horizontal side-track wellbore 154, such as the second portion of coiled tubing 160. In some implementations, the second tubing hanger 158 can be positioned within a second section of vertical production tubing 159. The second portion of coiled tubing 160 is installed into the horizontal side-track wellbore 154. The second portion of coiled tubing 160 has a pre-perforated section 162 defining perforations between a first end of the perforated section 162 and a second end of the perforated section 162. The perforated section 162 is positioned to align with a third zone of interest 164 within the second horizontal side-track wellbore 154.

A fifth isolation packer 166 surround the second portion of coiled tubing 160. The fifth isolation packer 166 is attached to an outer surface of the second portion of coiled tubing 160 at a first end of the third pre-perforated section 162. A sixth isolation packer 168 surrounds the second portion of coiled tubing 160. The sixth isolation packer 168 is attached to an outer surface of the second portion of coiled tubing 160 at the second end of the second pre-perforated section 162. The fifth packer 166 and the sixth packer 168 are installed onto the portion of coiled tubing 160 prior to the second portion of coiled tubing 160 being installed into the second horizontal wellbore 154. The packers are full-bore packers, meaning they are configured to fluidically isolate an annulus defined by an outer surface of the second portion of coiled tubing 160 and an inner surface of the second horizontal side-track wellbore 154. The packers are positioned such that, when activated, the fifth packer 166 and the sixth packer 168 fluidically isolate a region of the wellbore adjacent to the third zone of interest 164. By fluidically isolating that region of the horizontal side-track wellbore 154, the fifth packer 166 and the sixth packer 168 direct fluid between the second portion of coiled tubing 160 and the third zone of interest 164. The second portion of coiled tubing 160 can be used for either injection (such as liquid or gas injection) or for fluid production.

In some implementations, the second portion of coiled tubing 160 can be used for fracturing operations. In such an instance, the metallurgy and wall thickness of the second portion of coiled tubing 160 is such that the second portion of coiled tubing 160 has sufficient strength for the great pressures and flow rates involved in fracturing operations.

As previously described, the well completion 100 includes a vertical wellbore 102 fluidically coupled to the wellhead. In such an instance, the vertical well can be a production well, an injection well, or an abandoned well. When the vertical wellbore is either an injection or a production well, fluid can be flowing through the vertical wellbore 102 simultaneously while fluid is flowing through the horizontal wellbore 104. In such instances, the wellhead 106 can include multiple tubing hangers and multiple fluid connections to connect each well to the topside facility. In some instances, the fluid flows between the vertical wellbore 102 and the horizontal wellbore 104 can be commingled. The fluids can commingle at the topside facility, within the wellhead 106, or both.

Either of the previously described side-track horizontal wellbores (104 and 154) can be added later in the production life of a production field. That is, the additional wellbores can be drilled and completed after the vertical wellbore has been producing or injecting for some time. While two side-track horizontal wellbores (104 and 154) are illustrated in FIG. 1, more or fewer horizontal wellbores can be used. While all of the completed wells have been described as being either injection or production wells, it should be noted that individual wells in each figure can be used for different roles. For example, the two side-track horizontal wellbores (104 and 154) can be used for production, while the vertical wellbore 102 can be used for injection. While the first side-track horizontal wellbore 104 was described with a first set of perforations 112 along a first zone of interest 114 and a second set of perforations 120 along a second zone of interest 122, more or fewer perforated sections, zones of interest, or both, can be present in other installations. While a single portion of coiled tubing 110 is shown fluidically connected to multiple zones of interest, additional lengths of coiled tubing can be used for each zone of interest. In such implementations, a second length of coiled tubing can be run coaxially or parallel to the first portion of coiled tubing. In some implementations, more or fewer packers can be used throughout the installation to provide additional sealing or centralization.

Figure 2:
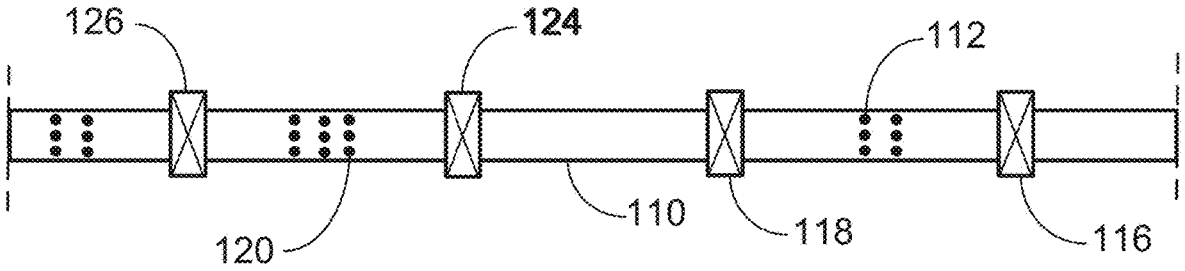
FIG. 2 is a schematic diagram of an example pre-perforated length of coiled tubing string that can be used with aspects of this disclosure.

FIG. 2 is a schematic diagram of an example pre-perforated length of coiled tubing string that can be used with aspects of this disclosure, such as the portion of coiled tubing 110. As previously described, the portion of coiled tubing 110 includes a first set of perforations 112 with a first packer 116 and a second packer 118 positioned on either side of the first set of perforations. The portion of coiled tubing 110 also includes a second set of perforations 120 with a third packer 124 and a fourth packer 126 positioned on either side of the second set of perforations 120. The first set of perforations 112 and the second set of perforations 120 can be different from one another. For example, the second set of perforations 120 can include a greater number of perforations than the first set of perforations 112. The size and number of perforations is dependent upon the desired flow characteristics for each zone of interest. Each set of perforations is formed prior to the portion of coiled tubing 110 being placed in the wellbore. The desired size, location, and number of perforations in each set of perforations is determined based on well logs prior to the portion of coiled tubing 110 being installed. The packers (116, 118, 124, and 126) are pre-installed on the portion of coiled tubing 110 prior to installation. In some implementations, the packers are connected to control lines (not shown) that run along the length of coiled tubing between each packer and a topside facility. Actuation of each packer is controlled at the topside facility. In some implementations, additional valving can be included within the portion of coiled tubing 110. The additional valves can be controlled from the topside facility to turn individual sections of the length of coiled tubing "on" or "off". That is, perforated sections can be fluidically isolated from the rest of the portion of coiled tubing if an operator desires.

Figure 3:
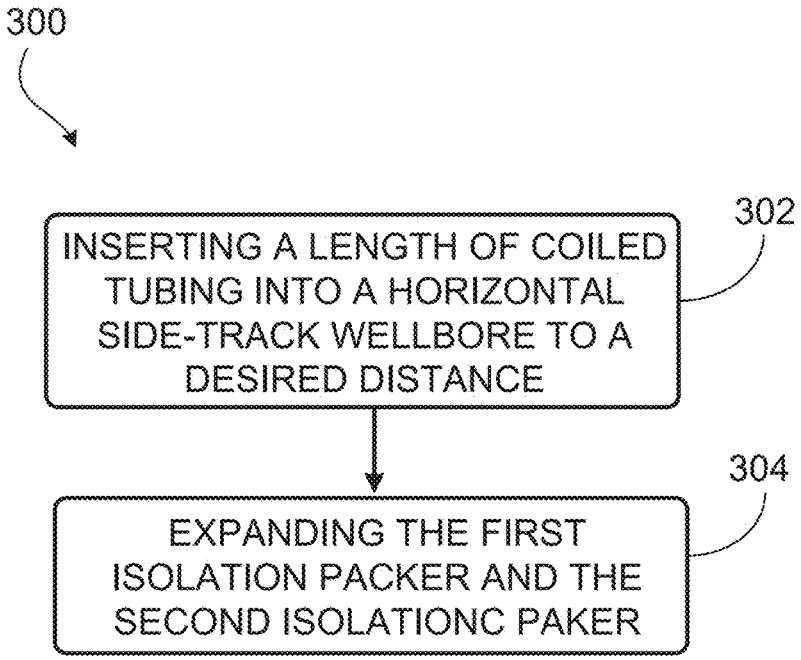
FIG. 3 is a flowchart of an example method that can be used with aspects of this disclosure.

FIG. 3 is a flowchart of an example method 300 that can be used with aspects of this disclosure. At 302, a portion of coiled tubing is inserted into a horizontal side-track wellbore to a desired distance. The portion of coiled tubing includes a pre-perforated section defining perforations between a first end of the perforated section and a second end of the perforated section. The perforated section is positioned, after being inserted into the horizontal side-track wellbore, to align with a zone of interest within the horizontal side-track wellbore. The portion of coiled tubing also includes a first isolation packer and a second isolation packer that surround the portion of coiled tubing at a first end of the pre-perforated section and a second end of the perforated section respectively. The coiled tubing is installed in an overbalanced condition. That is, fluid is being pumped through the coiled tubing at a greater pressure than fluids within the zones of interest. In some implementations, the pumped fluid can act as a lubricant to ease installation of the portion of coiled tubing.

Once the portion of coiled tubing has been inserted to the desired distance, at 304, the first isolation packer and the second isolation packer are expanded. In some instances, after the portion of coiled tubing is installed and the packers are expanded, a production fluid is flowed through the pre-perforated section and through the portion of coiled tubing to a topside facility. In some implementations, where there are multiple perforated sections fluidically connected to multiple zones of interest, a flow from the first pre-perforated section and the second pre-perforated section are commingled. In some instances, after the portion of coiled tubing is installed and the packers are expanded, an injection fluid is flowed from a topside facility, through the length of coiled tubing, and out the pre-perforated section or sections.

Once the well has reached the end of its useful life, the horizontal side-track wellbore is abandoned. In some instances, abandoning the wellbore can include removing the portion of coiled tubing from the horizontal side-track wellbore and leaving the packers within the horizontal side-track wellbore. In some instances, the removed portion of coiled tubing is installed into a second horizontal side-track wellbore that is separate and distinct from the first horizontal side-track wellbore. In some instances, abandoning the wellbore can include leaving the portion of coiled tubing within the horizontal side-track wellbore and leaving the packers within the horizontal side-track wellbore. The horizontal side-track wellbore can then be plugged with cement during abandonment.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may have been previously described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

positioning a first coiled tubing hanger within a vertical production tubing;

inserting a first length of coiled tubing supported by the first coiled tubing hanger into a first horizontal side-track wellbore to a desired distance, wherein the first length of coiled tubing comprises:

a first perforated section defining perforations between a first end of the first perforated section and a second end of the first perforated section, the first perforated section positioned to align with a first zone of interest within the first horizontal side-track wellbore;

a first isolation packer surrounding the first length of coiled tubing, the first isolation packer attached to the first length of coiled tubing at the first end of the first perforated section; and a second isolation packer surrounding the first length of coiled tubing, the second isolation packer attached to the first length of coiled tubing at the second end of the first perforated section;

flowing a first production fluid from the first zone of interest through the first perforated section and through the first length of coiled tubing to a topside facility;

positioning a second coiled tubing hanger within the vertical production tubing;

inserting a second length of coiled tubing supported by the second coiled tubing hanger into a second horizontal side-track wellbore to a desired distance, wherein the second length of coiled tubing comprises:

a second perforated section defining perforations between a first end of the second perforated section and a second end of the second perforated section, the second perforated section positioned to align with a second zone of interest within the second horizontal side-track wellbore;

a third isolation packer surrounding the second length of coiled tubing, the third isolation packer attached to the second length of coiled tubing at the first end of the second perforated section; and a fourth isolation packer surrounding the second length of coiled tubing, the fourth isolation packer attached to the second length of coiled tubing at the second end of the second perforated section; and flowing a second production fluid from the second zone of interest through the second perforated section and through the second length of coiled tubing to the topside facility.

2. The method of claim 1, further comprising expanding the first isolation packer and the second isolation packer once the first length of coiled tubing is inserted to the desired distance.

3. The method of claim 1, wherein the coiled tubing is installed in an overbalanced condition.

4. The method of claim 1, further comprising commingling a flow from the first perforated section and the second perforated section.

5. The method of claim 1, further comprising flowing an injection fluid from a topside facility, through the length of coiled tubing, and out the first perforated section.

6. The method of claim 1, further comprising abandoning the first horizontal side-track wellbore.

7. The method of claim 6, wherein abandoning comprises:

removing the length of coiled tubing from the first horizontal side-track wellbore; and leaving the packers within the first horizontal side-track wellbore.

8. The method of claim 6, wherein abandoning comprises:

leaving the length of coiled tubing within the first horizontal side-track wellbore; and leaving the packers within the first horizontal side-track wellbore.

* * * * *